United States Patent [19]

Sougawa

[11] Patent Number: 4,770,132

[45] Date of Patent: Sep. 13, 1988

[54] DRAINING SYSTEM FOR OUTBOARD ENGINE

[75] Inventor: Masafuni Sougawa, Hamamatsu, Japan

[73] Assignee: Sanshin Kogyo Kabushiki Kaisha, Hamamatsu, Japan

[21] Appl. No.: 66,815

[22] Filed: Jun. 25, 1987

[30] Foreign Application Priority Data

Jul. 3, 1986 [JP] Japan ..... 61-156911

[51] Int. Cl.[4] ..... F02B 33/04

[52] U.S. Cl. ..... 123/73 A; 123/73 SC

[58] Field of Search ..... 123/73 A, 73 AV, 73 B, 123/73 SC, 73 PP

[56] References Cited

U.S. PATENT DOCUMENTS

| | | | |
|---|---|---|---|
| 3,859,967 | 1/1975 | Turner et al. | 123/73 A |
| 4,359,975 | 11/1982 | Heidner | 123/73 R |
| 4,461,250 | 7/1984 | Mohr | 123/73 A |
| 4,579,093 | 4/1986 | Eanes | 123/69 R |
| 4,590,897 | 5/1986 | Hundertmark | 123/73 A |
| 4,690,109 | 9/1987 | Ogasahara et al. | 123/73 A |

FOREIGN PATENT DOCUMENTS

| | | | |
|---|---|---|---|
| 0181962 | 11/1982 | Japan | 123/73 SC |

*Primary Examiner*—Charles J. Myhre
*Assistant Examiner*—David A. Okonsky
*Attorney, Agent, or Firm*—Ernest A. Beutler

[57] ABSTRACT

An outboard motor powered by a two-cycle crankcase compression internal combustion engine. A system is incorporated for draining condensed fuel from a plurality of locations in the engine induction system through a common conduit to a combustion chamber for combustion.

12 Claims, 2 Drawing Sheets

DRAINING SYSTEM FOR OUTBOARD ENGINE

BACKGROUND OF THE INVENTION

This invention relates to a draining system for an outboard engine and more particularly to an improved drain system for collecting condensed liquid fuel from a plurality of location in an intake manifold and delivering it to a combustion chamber of the engine.

As is well known, crankcase compression two-cycle internal combustion engines are prone to uneven running conditions due to the condensation of fuel in the intake system and crankcase chamber. One reason why condensation is a problem with crankcase compression two cycle engines is that the fuel air mixture must travel a long distance from he charge former to the combustion chamber since it passes through the crankcase before entering the combustion chamber. In addition, it is normally the practice to employ a reed valve assembly in the induction system so as to prevent reverse flow and the reed valve and area around it may offer areas where fuel is likely to condense.

In addition, when the engine is employed as a power unit for a device such as an outboard motor, the engine is adapted to be steered and tilted between a wide variety of positions. Therefore, there are areas of the induction system which may form low points where fuel can collect and these low points can vary depending on the steering and trimmed attitude of the engine.

It is, therefore, a principal object of this invention to provide an improved and simplified arrangement for collecting condensed fuel from the induction system of an internal combustion engine of the crankcase compression pipe and delivering it to a combustion chamber.

It is a further object of this invention to provide an improved system for collecting condensed liquid fuel from a wide variety of places in the induction system of an engine.

It is a further object of this invention to provide an improved and simplified arrangement for collecting condensed liquid fuel from all areas in an induction system and delivering it to a combustion chamber.

SUMMARY OF THE INVENTION

This invention is adapted to be embodied in a system for draining and burning condensed fuel in a two-cycle crankcase compression internal combustion engine that comprises a crankcase chamber. An induction system is incorporated for delivering a fuel air charge to the crankcase chamber. Means are also incorporated for delivering condensed fuel from the induction system to a combustion chamber which means comprises a plurality of drain openings formed in the induction passage at locations where liquid fuel is likely to accumulate under various running conditions and a common conduit interconnecting all of the drain openings with a combustion chamber.

DETAILED DESCRIPTION OF THE PREFERRED EMBODIMENT OF THE INVENTION

Figure 1:
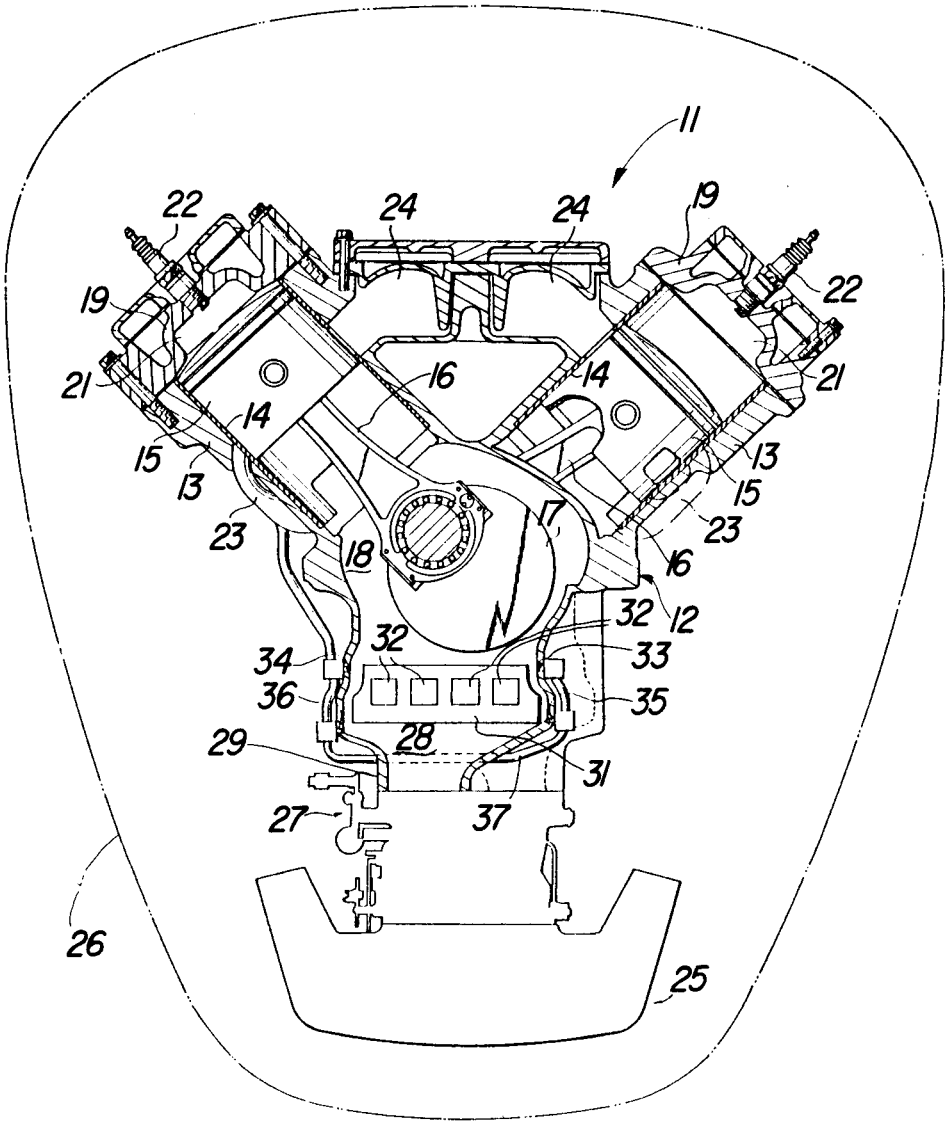
FIG. 1 is a top plan view of an outboard motor constructed in accordance with an embodiment of the invention with portions shown in phantom and other portions broken away.
Figure 2:
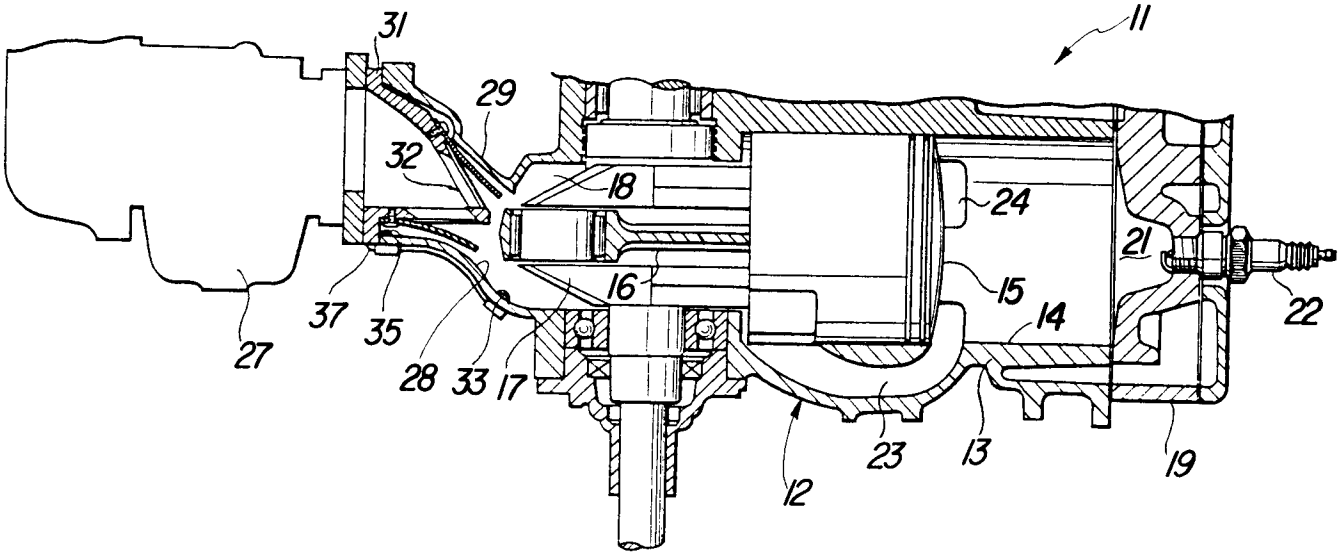
FIG. 2 is a cross-sectional view of the engine taken through one of the cylinders and showing its induction system.

In the drawings the reference numeral 11 indicates generally a two-cycle crankcase compression internal combustion engine of the type employed for powering an outboard motor. Although the invention is described in conjunction with an outboard motor, it is to be understood that it may be practiced with other applications for such types of engines. However, the invention has particular utility when the output shaft of the engine rotates about a vertically extending axis. The engine 11 is depicted as being of the V type. However, it is to be understood that the invention may be practiced with engines having a different number of cylinders or with engines having aligned cylinders.

The engine 11 includes a cylinder block 12 having angularly inclined cylinder banks 13. Each cylinder bank 13 is provided with a plurality of vertically spaced cylinder bores 14 which may be formed by liners inserted into the cylinder block 12. Pistons 15 are supported for reciprocation within the individual cylinder bores 14 and are connected by means of connecting rods 16 to a crankshaft 17. The crankshaft 17 is rotatably journaled within a crankcase chamber 18 for rotation about a vertically disposed axis in any known manner.

A cylinder head 19 is affixed to each of the cylinder banks 13 in a known manner. Each cylinder head 19 is formed with a plurality of recesses 21 which recesses 21 cooperate with the cylinder bores 14 and pistons 15 to form the combustion chambers. In addition, spark plugs 22 are supported within the cylinder heads 19 and have their gaps disposed in the recesses 21 for firing the charge in a known manner.

In accordance with normal two-cycle engine practice, the crankcase chamber 18 is divided into a plurality of individual, separate vertically spaced chambers each of which is associated with a respective one of the cylinders 14. These chambers are sealed from each other in a known manner. A fuel air charge is introduced to each of the sealed chambers through an induction system, to be described, when the associated piston 15 is ascending within its cylinder bore 14. This charge is then compressed as the piston 15 moves downwardly and the compressed charge is transferred through one or more transfer passages 23 from the crankcase chambers to the area in the cylinder bore 14 above the head of the piston 15 for eventual firing.

The charge which has been burnt by firing of the spark plugs 21 is discharged from the individual combustion chambers through exhaust ports 24. The exhaust ports 24 are disposed in the bank of the V as shown in FIG. 1 and communicate with an exhaust manifold for discharge of the exhaust gases to the atmosphere. When the engine 11 is used in conjunction with an outboard motor, a typical underwater exhaust system of any known type (not shown) may be employed.

The induction system for the engine 11 includes an air intake device 25 that is disposed within a protective cowling, shown in phantom in FIG. 1 and identified by the reference numeral 26. The intake device 25 is designed so as to the silence the intake air and to distribute it to three vertically disposed, two barrel carburetors 27, only one of which appears in the drawings.

Each carburetor 27 has one of its barrels communicating with an induction passage 28 that is formed in an intake manifold 29. The intake manifold 29 is interposed between a respective carburetor 27 and the crankcase of the engine so as to deliver a fuel air charge to the respective sealed crankcase chamber 17. A reed valve assembly comprised of a body portion 31 and a pair of reed valve plates 32 is interposed between each carburetor barrel and the manifold induction passages 28 so as to prevent reverse flow.

It should be noted that some or all of the induction passages 28 are inclined or curve downwardly from the carburetor barrel to the crankcase chamber 18. Some or all of the intake passages 28 may also curve upwardly from the respective carburetor barrels to the crankcase chambers 18. As a result of this curvature, fuel may tend to condense in the intake passages 28 and cause uneven running. In addition, the outboard motor is adapted to be operated through various trimmed positions and also through various steered positions and the condensed fuel may run to certain low spots depending upon the trim condition or sides depending upon the steered condition. A system is provided for insuring that the condensed fuel will be drawn uniformly into the combustion chambers 21 and prevent uneven running regardless of the steered or trimmed condition of the outboard motor.

This draining system comprises a pair of low and side positioned drain openings 33 and 34 that are disposed at opposite sides of the intake manifold passage 28 at its lower most position when the outboard motor is in its normally trimmed condition. In addition, there are provided a pair of upper, rear drain openings 35 and 36 that are located at the sides of the intake passage 28 and at a higher point and under the check valve bodies 31 so as to be positioned to collect drains when the outboard motor is in its trimmed upper condition. As a result, any condensed fuel will be drawn through at one or more of the openings 33, 34, 35 and 36 regardless of the orientation of the engine. A single conduit 37 extends from each of the openings 33, 34, 35 and 36 to a respective combustion chamber 21, for example by communicating with the transfer passage 23 so that all of these drain openings will discharge into a given combustion chamber through a single conduit 37. It should be noted that the conduit 37 may communicate with a transfer passage 23 of the same combustion chamber served by the intake passage 28 or one of another cylinder. Also, a check valve may be positioned in the conduit 37 between its point of discharge into the transfer passage 23 and all of the openings 33, 34, 35 and 36 so as to prevent any reverse flow.

It should be readily apparent from the foregoing description that a very affective and very simple draining system is provided that will insure that any condensed fuel will be delivered uniformly to the combustion chambers regardless of the steered or trimmed condition of the outboard motor. Also, it is also to be understood that the foregoing description is only that of the preferred embodiment of the invention and that various changes and modifications may be made without departing from the spirit and scope of the invention, as defined by the appended claims.

I claim:

1. A system for draining and burning condensed fuel in a two cycle crankcase compression internal combustion engine comprising a crankcase chamber containing a single crank throw, an induction passage for delivering a fuel air charge to said crankcase chamber, and means for delivering condensed fuel from said induction passage to a combustion chamber comprising a plurality of drain openings formed in said induction passage at locations where liquid fuel is likely to accumulate under various engine orientations and a common conduit interconnecting all of said drain openings with said combustion chamber.

2. A system as set forth in claim 1 wherein the common conduit interconnects all of the drain openings with a combustion chamber served by the crankcase chamber.

3. A system as set forth in claim 2 wherein the common conduit opens into a transfer passage means that communicates the crankcase chamber with the combustion chamber.

4. A system as set forth in claim 3 further including check valve means in said conduit means for precluding reverse flow from said transfer passage means into said conduit means.

5. A system as set forth in claim 1 further including a reed type check valve in said induction system for precluding reverse flow through said induction system, at least some of said drain openings being positioned in proximity to said reed type check valve means.

6. A system as set forth in claim 1 wherein the engine is employed in connection with an outboard motor adapted to be steered about a vertically extending axis and trimmed and tilted about a horizontally extending axis and wherein the induction passage extends in a generally longitudinal direction relative to the outboard motor, some of said drain openings being longitudinally spaced along the induction passage and other of the drain passages being spaced vertically along the induction passage.

7. A system as set forth in claim 1 wherein the crankcase chamber is formed at the base of a cylinder bore containing a piston connected by means of a connecting rod to the single crank throw.

8. A system as set forth in claim 7 wherein the common conduit interconnects all of the drain openings with the combustion chamber formed by the cylinder bore.

9. A system as set forth in claim 8 further including a transfer passage communicating the combustion chamber with the crankcase and wherein the common conduit opens directly into said transfer passage.

10. A system as set forth in claim 1 wherein the engine is supported for movement about a first axis and wherein the drain openings are disposed at locations spaced from the axis and positioned to receive gravity flow of condensed fuel when the engine is moved about the axis.

11. A system as set forth in claim 10 wherein the axis is a vertically disposed axis.

12. A system as set forth in claim 10 wherein the axis is a horizontally disposed axis.

* * * * *